US007028840B2

(12) United States Patent
Huang et al.

(10) Patent No.: US 7,028,840 B2
(45) Date of Patent: Apr. 18, 2006

(54) PACKAGE AND METHOD FOR STORING AND DISPENSING WET WIPES IN A POP-UP FORMAT

(75) Inventors: Yung Hsiang Huang, Appleton, WI (US); Robert Samuel Schlaupitz, New London, WI (US); Mei-Chiung Huang, Neenah, WI (US); Rodney Carlton Christianson, Oshkosh, WI (US); Paige Annette Dellerman, Appleton, WI (US); Timothy Walter Shoaf, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 416 days.

(21) Appl. No.: 10/050,801

(22) Filed: Dec. 19, 2001

(65) Prior Publication Data

US 2003/0111378 A1 Jun. 19, 2003

(51) Int. Cl.
*B65D 73/00* (2006.01)

(52) U.S. Cl. ..... 206/494; 206/775; 206/812; 221/63

(58) Field of Classification Search ..... 206/494, 206/409, 812, 459.5, 775–778; 221/46, 45, 221/63

See application file for complete search history.

(56) References Cited

U.S. PATENT DOCUMENTS

| | | | | |
|---|---|---|---|---|
| 2,004,614 | A | 6/1935 | Meagher | |
| 2,735,542 | A | 2/1956 | Shnitzler | |
| 2,842,178 | A | 7/1958 | Solomon | |
| 3,095,991 | A | 7/1963 | Paniagua | |
| 3,239,097 | A | 3/1966 | Bates et al. | |
| 3,369,699 | A | 2/1968 | Enloe et al. | |
| 3,383,009 | A | 5/1968 | Weikert | |
| 3,737,067 | A | 6/1973 | Palson | |
| 3,747,802 | A | 7/1973 | Uroshevich | |
| 3,749,296 | A | 7/1973 | Harrison | |
| 3,780,908 | A | 12/1973 | Fitzpatrick et al. | |
| 3,784,056 | A * | 1/1974 | Spruyt et al. | 206/494 |
| 3,836,044 | A | 9/1974 | Tilp et al. | |

(Continued)

FOREIGN PATENT DOCUMENTS

EP 0068722 B1 4/1988

(Continued)

OTHER PUBLICATIONS

Patent Abstracts of Japan 60127337 A: Description of Toru et al., "Transparent Container made of Polypropylene Resin."

(Continued)

*Primary Examiner*—Luan K. Bui
(74) *Attorney, Agent, or Firm*—Michael J. Bondel; Scott A. Baum

(57) ABSTRACT

The invention relates to a package and method for storing and dispensing wet wipes in a pop-up format. A group of wet wipes are positioned in a container base between the container base and a pop-up style dispensing partition, each wipe in the group of wet wipes having a first visibility index. The container top has a second visibility index and the pop-up style dispensing partition has a third visibility index and the first visibility index is different than the third visibility index such that when the container top is closed the wipe from the group of wet wipes is visibly indicated at the container top as being in-position or not-in-position for pop-up dispensing as soon as the container top is next opened.

16 Claims, 4 Drawing Sheets

U.S. PATENT DOCUMENTS

| | | | | |
|---|---|---|---|---|
| 3,868,052 | A | | 2/1975 | Rockefeller |
| 3,967,756 | A | | 7/1976 | Barish |
| 3,979,019 | A | | 9/1976 | Bliss |
| 3,994,417 | A | | 11/1976 | Boedecker |
| 4,004,687 | A | | 1/1977 | Boone |
| 4,017,002 | A | | 4/1977 | Doyle et al. |
| 4,079,880 | A | | 3/1978 | Edwards |
| 4,133,457 | A | | 1/1979 | Klassen |
| 4,180,160 | A | | 12/1979 | Ogawa et al. |
| 4,200,200 | A | | 4/1980 | Hein, III et al. |
| 4,289,262 | A | | 9/1981 | Finkelstein |
| 4,337,876 | A | | 7/1982 | Thompson |
| 4,377,245 | A | | 3/1983 | Patty |
| 4,522,312 | A | | 6/1985 | Rathberger et al. |
| 4,671,408 | A | | 6/1987 | Raines et al. |
| 4,681,240 | A | | 7/1987 | Wyant |
| 4,684,024 | A | | 8/1987 | Ebrahim et al. |
| 4,694,973 | A | | 9/1987 | Rose et al. |
| 4,730,731 | A | | 3/1988 | Allison |
| 4,746,008 | A | | 5/1988 | Heverly et al. |
| 4,784,290 | A | | 11/1988 | Howard |
| 4,787,526 | A | | 11/1988 | Pehr |
| 4,848,575 | A | | 7/1989 | Nakamura et al. |
| 4,890,742 | A | | 1/1990 | Allison |
| 4,925,041 | A | | 5/1990 | Pehr |
| 4,938,513 | A | | 7/1990 | Gunderson |
| 4,971,372 | A | | 11/1990 | Gunderson |
| 4,976,370 | A | | 12/1990 | Cassel |
| 4,986,438 | A | | 1/1991 | Borst |
| 4,989,747 | A | | 2/1991 | Demurger |
| 5,033,778 | A | | 7/1991 | Niles et al. |
| 5,050,737 | A | | 9/1991 | Joslyn et al. |
| 5,050,762 | A | | 9/1991 | Giorgi |
| 5,100,015 | A | | 3/1992 | Vanderstuyf |
| 5,148,951 | A | | 9/1992 | Moure et al. |
| 5,322,178 | A | * | 6/1994 | Foos ..... 206/494 |
| 5,542,567 | A | | 8/1996 | Julius |
| 5,704,471 | A | | 1/1998 | Yamada |
| D395,952 | S | | 7/1998 | Buczwinski et al. |
| 5,785,179 | A | | 7/1998 | Buczwinski et al. |
| 5,908,138 | A | | 6/1999 | Vlahakis et al. |
| 5,957,325 | A | | 9/1999 | Montanez |
| D414,637 | S | | 10/1999 | Amundson et al. |
| 6,053,357 | A | | 4/2000 | Yoh |
| 6,152,322 | A | | 11/2000 | Marino |
| D437,686 | S | | 2/2001 | Balzar et al. |
| D443,451 | S | | 2/2001 | Buck et al. |
| 6,194,536 | B1 | | 2/2001 | Schmidt et al. |
| 6,269,970 | B1 | * | 8/2001 | Huang et al. ..... 220/836 |
| D449,528 | S | | 10/2001 | Buck et al. |

FOREIGN PATENT DOCUMENTS

| | | | |
|---|---|---|---|
| EP | 0449580 | A1 | 10/1991 |
| EP | 0331027 | B1 | 1/1992 |
| EP | 0644130 | A1 | 3/1995 |
| EP | 0744357 | A1 | 11/1996 |
| EP | 1081194 | A1 | 3/2001 |
| FR | 2306359 | | 10/1976 |
| GB | 793745 | | 4/1958 |
| GB | 1 280 218 | | 7/1972 |
| JP | 05338660 | A | 12/1993 |
| WO | WO 99/55599 | | 11/1999 |
| WO | WO 00/63085 | A1 | 10/2000 |
| WO | WO 00/65972 | A1 | 11/2000 |
| WO | WO 01/74687 | A1 | 10/2001 |

OTHER PUBLICATIONS

American Society for Testing Materials (ASTM) Designation: D 412-98a, "Standard Test Methods for Vulcanized Rubber and Thermoplastic Elastomers—Tension," pp. 43-55, published Aug. 1998.

American Society for Testing Materials (ASTM) Designation: D 790-99, "Standard Test Methods for Flexural Properties of Unreinforced and Reinforced Plastics and Electrical Insulating Materials," pp. 150-158, published Feb. 2000.

American Society for Testing Materials (ASTM) Designation: D 1003-00, "Standard Test Method for Haze and Luminous Transmittance of Transparent Plastics," pp. 1-6, published Jul. 2000.

American Society for Testing Materials (ASTM) Designation: D 1044-99, "Standard Test Method for Resistance of Transparent Plastics to Surface Abrasion," pp. 224-227, published Oct. 1999.

American Society for Testing Materials (ASTM) Designation: D 2240-97, "Standard Test Method for Rubber Property—Durometer Hardness," pp. 400-403, published Mar. 1997.

American Society for Testing Materials (ASTM) Designation: D 6125-97, "Standard Test Method for Bending Resistance of Paper and Paperboard (Gurley Type Tester)," pp. 885-889, published Feb. 1998.

* cited by examiner

PACKAGE AND METHOD FOR STORING AND DISPENSING WET WIPES IN A POP-UP FORMAT

BACKGROUND OF THE INVENTION

Wet wipes have been made from a variety of materials. Wet wipes can be moistened with a variety of suitable wiping solutions. Typically, wet wipes have been stacked in a package in either a folded or unfolded configuration. For example, containers or dispensers for wet wipes have been available wherein each of the wet wipes stacked in the container has been arranged in a folded configuration such as a c-folded, z-folded or quarter-folded configuration as are well known to those skilled in the art. Sometimes the folded wet wipes have also been interfolded with the wet wipes immediately above and below in the stack of wet wipes. In an alternative configuration, the wet wipes have been placed in the container in the form of a continuous web of material which includes perforations to separate the individual wet wipes and which can be formed in a stack or wound into a roll for the group of wipes. Such wet wipes have been used for baby wipes, hand wipes, household cleaning wipes, industrial wipes and the like.

The conventional packages which contain wipes, such as those described above, have typically been designed to be positioned on a flat surface such as a countertop, changing table or the like. Such conventional packages have generally provided a plastic container, tub or package which provides a sealed environment for the wet wipes to ensure that they do not become overly dry. Some of the conventional packages have also been configured to provide one at a time dispensing of each wet wipe which can be accomplished using a single hand after the package has been opened. Such single handed, one at a time dispensing, often referred to as "pop-up" dispensing, is particularly desirable because the other hand of the user or care giver is typically required to be simultaneously used for other functions. For example, when changing a diaper product on an infant, the care giver typically uses one hand to hold and maintain the infant in a desired position while the other hand is attempting to dispense a baby wipe to clean the infant.

However, the dispensing of wipes from such conventional containers for wipes has not been completely satisfactory. For example, this is due at least in part to the ability of the package to visibly indicate whether a wipe in the container is in-position or not-in-position for pop-up dispensing before the container is opened and a wipe is desired. In particular, for example, this can concern the configuration and characteristics of the wipes, the container top and the pop-up format dispensing means for dispensing wipes in a group of wipes that are separably joined to each adjacent wipe in the group to provide pop-up dispensing once an initial wipe in the group is dispensed through the orifice. The present invention builds upon the teaching disclosed in U.S. Ser. No. 09/538,711 filed Mar. 30, 2000 entitled "WET WIPE CONTAINER WITH FLEXIBLE ORIFICE" and that in U.S. Ser. No. 09/870,785 filed May 31, 2001 entitled "FLEXIBLE ORIFICE FOR WET WIPES DISPENSER", both assigned to the assignee of the present application and which prior applications are incorporated fully herein by reference.

SUMMARY OF THE INVENTION

In response to the difficulties and problems discussed above, for example, container configurations and characteristics enabling improved dispensing, and which may be more informative and reliable to the user, have been discovered. For example, dispensing can be improved or made easier when there is a visible indication, before the container is opened, that a wipe is ready for dispensing upon the opening of a resealable wipes dispenser and dispensing the wipe in a plurality of wipes. That is, dispensing can be improved when there is a visible indicator that a portion of the next or top wipe is positioned in an orifice of the dispenser sufficiently protruding so a user can readily grasp the same without having to thread or re-thread the top wipe in the group through the dispensing orifice after opening the container and before being able to dispense a wipe. As another example dispensing can be improved when there is a visual indicator, before the container is opened, that wipe fall back has occurred such that a user can have both hands free to re-thread the wipe before one hand engages in wiping (e.g., holding down or changing a baby, wiping a surface, etc.) and there is only the one other hand free to dispense wipes. Wipe fallback can occur when a leading wipe in a plurality of wipes separates completely from a following or trailing wipe prematurely, i.e., before a sufficient portion of the following wipe is positioned within the dispenser orifice to remain there for later dispensing after the leading wipe is fully separated or disjointed from the trailing wipe outside the dispenser. In such a fallback situation, the following wipe would need to be re-threaded through the dispensing orifice when its dispensing is next desired. This may not be undesirable if done intentionally, i.e., if maintaining a maximum moisture level for the wipes is desired and the dispensing orifice is designed to easily accommodate reach-in retrieval of the next wipe, but in any event a visual indicator would be helpful to the user so the user knows whether both hands may be needed before a wiping activity starts. The purposes and features of the present invention will be set forth in and are apparent from the description that follows, as well as will be learned by practice of the invention. Additional features of the invention will be realized and attained by the product and processes particularly pointed out in the written description and claims hereof, as well as from the appended drawings.

In one aspect, the invention provides a package for storing and dispensing wet wipes in a pop-up format. The packages comprises a container base connected with a container top and a pop-up style dispensing partition positioned between the container base and the container top. A group of wet wipes are positioned in the container base between the container base and the pop-up style dispensing partition, each wipe in the group of wet wipes having a first visibility index. The pop-up style dispensing partition comprises a dispensing orifice through which a wipe from the group of wet wipes is removed from the package when the top is open. The container top has a second visibility index and the pop-up style dispensing partition has a third visibility index. The first visibility index is different than the third visibility index such that when the container top is closed the wipe from the group of wet wipes is visibly indicated at the container top as being in-position or not-in-position for pop-up dispensing as soon as the container top is next opened.

In another aspect, the invention provides a method for storing and dispensing wet wipes in a pop-up format. In no required order, though it may be advantageous, the method comprises providing a plurality of wet wipes in a pop-up format in a package, the package comprising a container base connected with a container top and a pop-up style dispensing partition located between the container base and the container top. The method further and/or then comprises positioning a wipe from the plurality of wet wipes in a dispensing orifice of the pop-up style dispensing partition. The method also and/or then comprises visibly indicating at the container top when the container top is in a closed position whether a next wipe from the plurality of wet wipes is in-position or not-in-position for pop-up dispensing as soon as the container top is next opened.

In yet another aspect, the invention provides a method for storing and dispensing wet wipes in a pop-up format. In no required order, though it may be advantageous, the method comprises obtaining a plurality of wet wipes in a pop-up format in a package, the package comprising a container base connected with a container top and a pop-up style dispensing partition located between the container base and the container top. The method further and/or then comprises positioning a wipe from the plurality of wet wipes in a dispensing orifice of the pop-up style dispensing partition. The method also and/or then comprises opening the container top and dispensing the wipe from the dispensing orifice and then closing the container top. The method still further and/or then comprises visibly indicating at the container top when the container top is in a closed position whether a next wipe from the plurality of wet wipes is in-position or not-in-position for pop-up dispensing as soon as the container top is next opened.

In yet other aspects, the invention provides various configurations, relationships, and/or characteristics for the visibility indexes, package construction, and steps for making or using the invention.

Definitions

As used herein, wet wipes of the invention are considered "separably joined", "separably joining" (and variations thereof) when each wipe of a plurality, e.g., in a stack or roll of wipes, is engaging any adjacent wipe while in the dispenser or package such that withdrawing the leading wipe through the dispenser or package opening also withdraws at least a portion of the following wipe through the opening before the leading wipe and the following wipe separate completely from each other. Such engaging of any adjacent wipe can include an interfolded relationship or a non-interfolded relationship in combination with one or more of the following between adjacent wipes: adhesive, friction, cohesion, fusion bonding (e.g., ultrasonic welding, heat sealing), mechanical entanglement (e.g., needle punching, steam sealing, embossing, crimping), autogeneous bonding, and/or weakened line(s) (e.g., perforations, zones of frangibility, score line(s), crush cutting).

As used herein, when the following wipe that has at least a portion through the opening of the dispenser or package is intentionally maintained in the opening after the leading wipe is completely separated from the following wipe, this is referred to as "pop-up" format or dispensing. To be intentionally maintained in the opening means the opening is configured to so maintain the wipe therein, such as through use of a constricting orifice or opening being smaller than the wipe in at least one dimension of the wipe.

As used herein, "reach-in" dispensing is understood to mean having to fetch a wipe out of a dispenser through an opening substantially co-extensive with the walls of the dispenser or through a restricted opening smaller than the perimeter defined by the walls. In either case, the top wipe for dispensing rests on top of the remainder of the stack of wipes and the top wipe needs to be separated from the remainder of the stack each time anew when dispensing is desired. An example of a reach-in dispenser is found in the currently available baby wipes product sold by Kimberly-Clark Corporation of Neenah, Wis. under the trade name HUGGIES® Supreme Care.

As used herein, the term "rigid" is used to mean a level of stiffness commonly associated with materials used to manufacture wet wipes tubs. Numerically, these materials typically have a flexural modulus (as measured in accordance with ASTM D790 "Standard Test Method for Flexural Properties of Unreinforced and Reinforced Plastics and Electrical Insulating Materials") of about 500 Newtons per square millimeter or greater, more specifically from about 1100 to about 1550 Newtons per square millimeter.

As used herein, the term "wet wipe" refers to a fibrous sheet that has a liquid applied thereto during manufacture. The amount of liquid or solution contained within each wet wipe can vary depending upon the type of material being used to provide the wet wipe, the type of liquid being used, the type of container being used to store the stack of wet wipes, and the desired end use of the wet wipe. Generally, each wet wipe can contain from about 25 to about 600 weight percent or from about 200 to about 400 weight percent liquid based on the dry weight of the wipe, for improved wiping in certain situations. To determine the liquid add-on, first the weight of a just-manufactured dry wipe is determined. Then, the amount of liquid by weight equal to the weight of the just-manufactured dry wipe, or an increased amount of liquid measured as a percent add-on based on the weight of the just-manufactured dry wipe, is added to the wipe to make it moistened, and then known as a "wet wipe" or "wet wipes". The liquid may include a fragrance and/or an emollient and may serve to aid the fibrous sheet in retention of materials, which are to be wiped up during its utilization.

As used herein, the term "visibility index" is understood to mean an optical measurement of a material. The optical measurement comprises three visibility characteristics or parameters: total transmittance, haze and clarity. "Total transmittance" is understood to mean the ratio of transmitted light to the incident light passing through the material. "Haze" is understood to mean, in transmission, the scattering of light by the material responsible for the reduction in contrast of objects viewed through it. Haze can be determined as the percentage of transmitted light that deviates from the incident beam greater than 2.5 degrees on the average. "Clarity" is understood to mean how well the fine details of an object can be viewed through the material. Clarity is determined in an angle range smaller than 2.5 degrees by which the light is diffused.

As used herein, "visibility index test" is understood to mean employing an instrument known as a haze-gard plus™ (i.e., from BYK-Gardner-GmbH of Geretsried, Germany, known nationally as BYK-Gardner USA of Columbia, Md.) or the like and which conforms to the standards of ASTM D-1003 and ASTM D-1044, to measure the visibility index of a particular material, e.g., a wipe, a package wall or portion, or other material for which known the visibility index is desired. In practice, the material for which a visibility index is to be measured is prepared based on ASTM D-1003 and measured following the operating procedure of the haze-gard plus™ instrument. Each test specimen is cut from the material to yield a size large enough to cover the entrance port of the instrument sphere (e.g., at least approximately 1.5 cm in diameter). Also, each test specimen should have opposite surfaces free of dust, grease, scratches and blemishes, other than those intended for use with the material. The haze-gard plus™ instrument allows simultaneous measurement of the test specimen's three visibility characteristics or parameters, but this does not limit the invention, which only requires that one or more visibility characteristic be measurable as desired.

As used herein, one visibility index is "different" than another visibility index when there is a difference in any one of the three visibility characteristics for two materials being compared (e.g., wipe vs. dispensing partition) based on a comparison of the measured value for the same characteristic (e.g., the haze of the wipe versus the haze of the dispensing partition, the clarity of the wipe versus the clarity of the dispensing partition, or the total transmittance of the wipe versus the total transmittance of the dispensing partition).

It is to be understood that both the foregoing general description and the following detailed description are exemplary and are intended to provide further explanation of the invention claimed. The accompanying drawings, which are incorporated in and constitute part of this specification, are included to illustrate and provide a further understanding of the invention.

BRIEF DESCRIPTION OF THE DRAWINGS

The drawings are merely representative and are not intended to limit the scope of the claims. Like parts depicted in the drawings are referred to by the same reference numerals.

DETAILED DESCRIPTION OF THE INVENTION

As a result of their work, the inventors have determined that particular pop-up format package configurations and characteristics are better than others for overcoming some challenges to making dispensing of wet wipes in a pop-up format more user friendly. Such can be beneficial to, e.g., more accurate wipe retrieval and/or reducing the likelihood of opening a container top to unknowingly find wipe fallback. That is, the inventors believe they have discovered new, surprising and unexpected ways to indicate to a user the positioning of a wipe in a package before even opening the package to retrieve a wipe. This is particularly advantageous in a pop-up format package because of fallback or different dispensing habits by users of the same package that could include desired retrieval through a pop-up format dispensing orifice by one user but only pop-up retrieval format by another.

Figure 1:
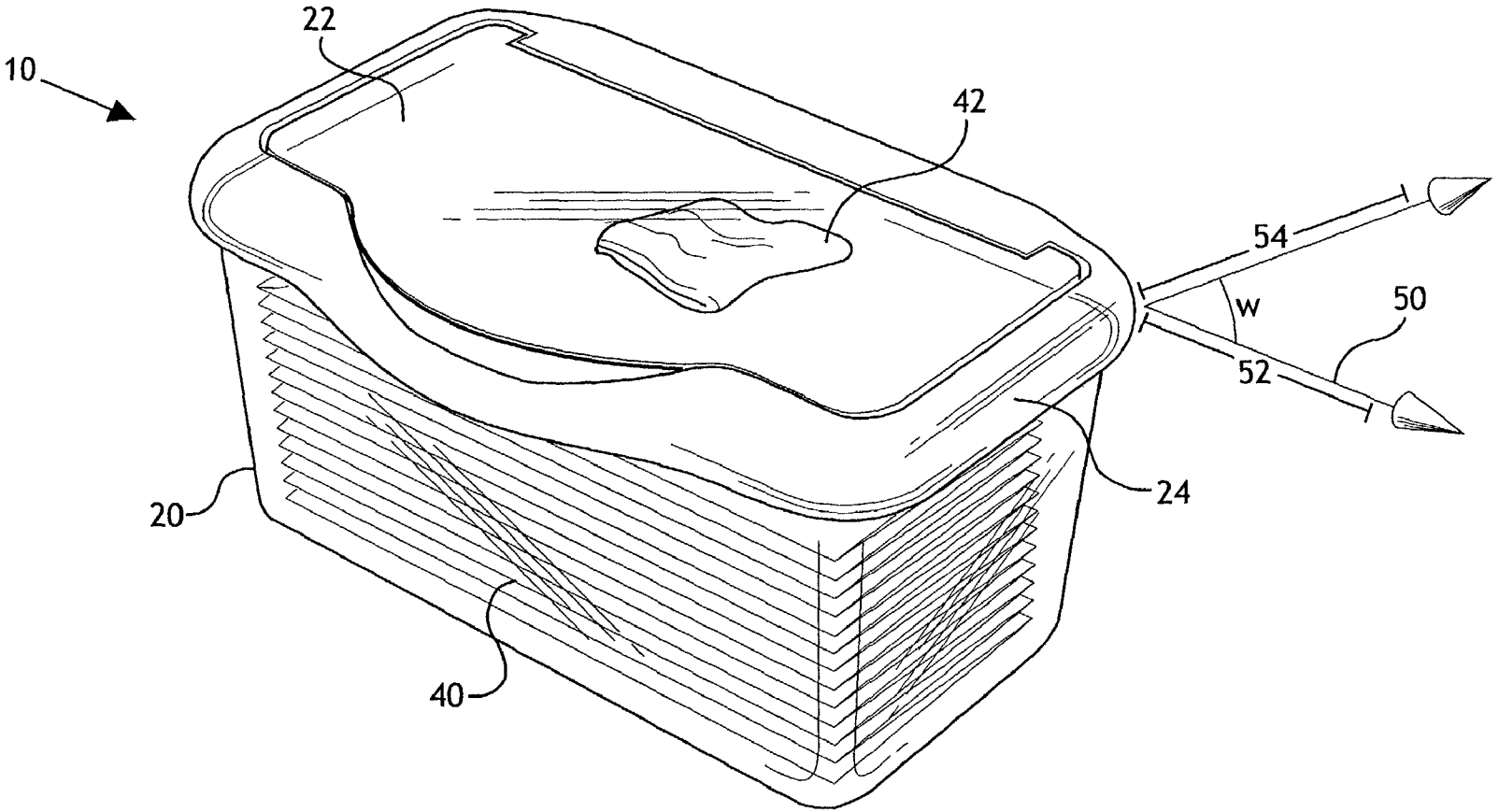
FIG. 1 representatively shows a perspective view of a package for storing and dispensing wipes in a pop-up format with the container top closed and a wipe visually indicated as being in-position for pop-up dispensing, in accordance with the present invention.
Figure 2:
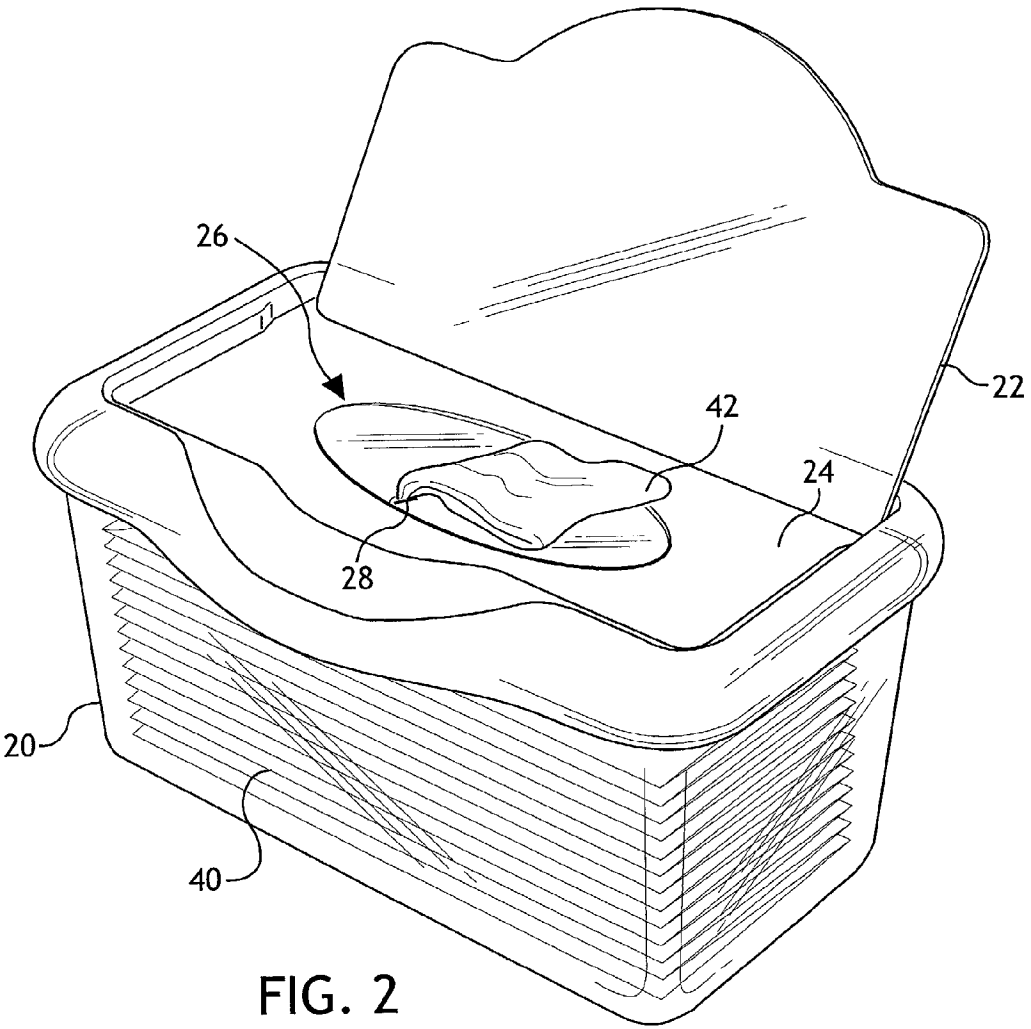
FIG. 2 representatively shows the package of FIG. 1 but with the container top open and the pop-uped wipe accessible for dispensing.
Figure 4:
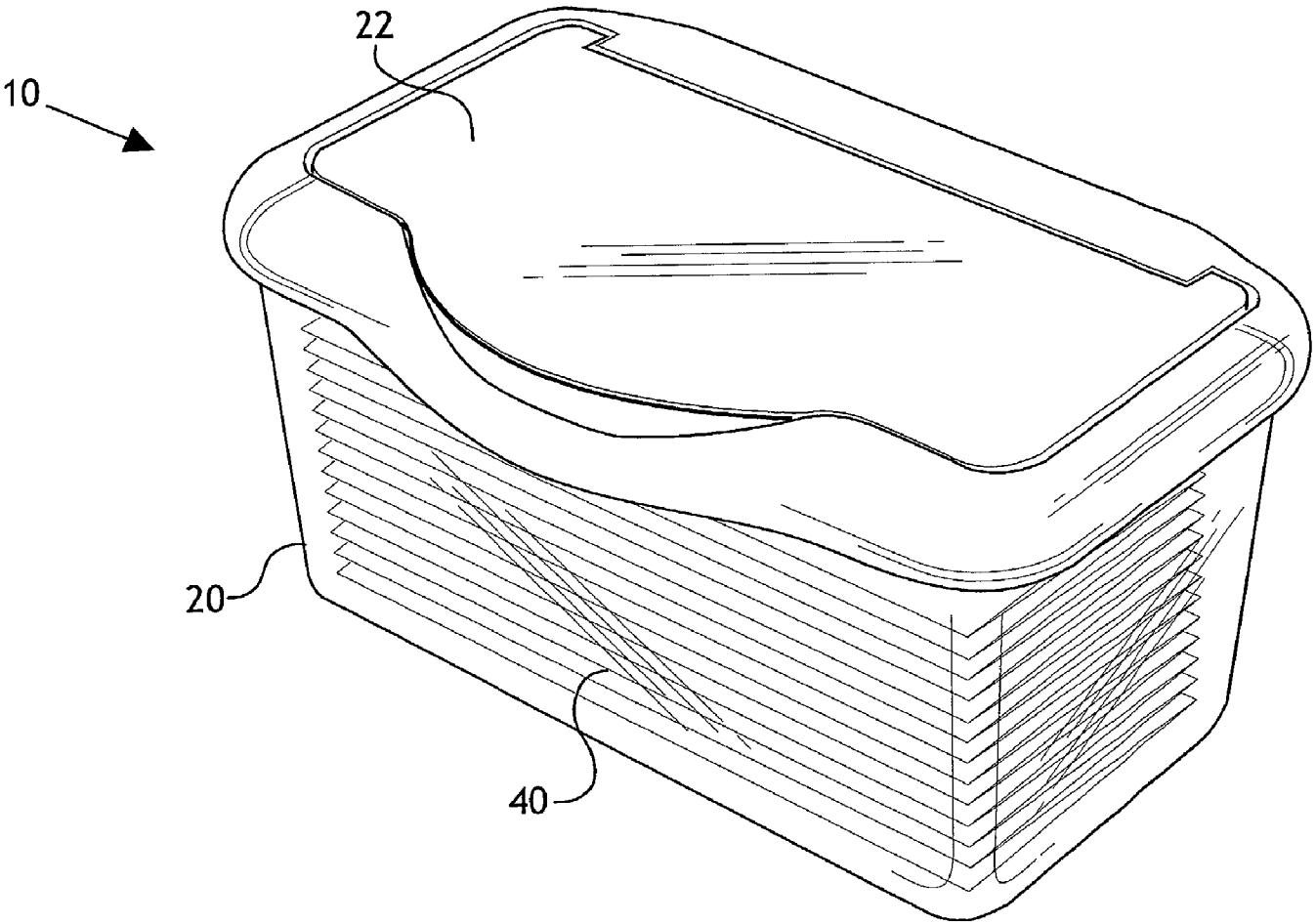
FIG. 4 representatively shows the package of FIG. 1 with a visible indication that a wipe is not-in-position for pop-up dispensing.

As representatively illustrated throughout the figures, and for explanation now referring to FIGS. 1 and 2, there is depicted a package 10 for storing and dispensing wet wipes in a pop-up format. Package 10 includes a container base 20 connected with a container top 22 and a pop-up style dispensing partition 24 positioned between the container base and the container top. A group of wet wipes 40 can be positioned or stored in the container base 20 between the container base and the pop-up style dispensing partition 24. Each wipe 42 in the group of wet wipes has a first visibility index. The dispensing partition 24 includes a dispensing orifice 26 through which a wipe 42 from the group of wet wipes 40 is removed from the package when the top is open. Orifice 26 could include a slit 28 and be rigid or of a flexible rubber-like material (e.g., as taught in U.S. Ser. Nos. 09/538,711 or 09/870,785 supra) or an opening (not shown, but like taught in, e.g., U.S. Des. Pat. No. 414,637 or PAMPERS® One-Ups!™ or other conventional similarly functioning containers). The container top 22 has a second visibility index and the pop-up style dispensing partition has a third visibility index. The first visibility index of the wipe 42 is different than the third visibility index of the partition 24 such that when the container top is closed (FIGS. 1 and 4) the wipe from the group of wet wipes is visibly indicated at the container top as being in-position (FIG. 1) or not-in-position (FIG. 4) for pop-up dispensing as soon as the container top is next opened.

As stated previously, the visibility for a particular material includes the three parameters of total transmittance, haze, and clarity, and the visibility index is a quantitative measure of optical characteristics of a material. When comparing the visibility index of several materials, and in particular those that interact with one another and/or are used in combination with one another, e.g. a package of wipes, the inventors have made a surprising and unexpected discovery. In particular, they have discovered that this comparison can be controlled to visibly indicate the positioning of one material relative to another, e.g., an object inside a package, as determined by the visibility indexes of the materials. e.g., a package wall and a wipe. In turn, this is related to a qualitative visibility indication as seen through a pair of human eyes (i.e., preferably with 20/20 vision) viewing the closed package at a set elevation and a set distance, such that the human can determine the positioning of a desired material within the package. In another aspect, the ability to control this comparison (i.e., and thus be able to manipulate it with accuracy, if desired) can provide a broader operating window for available materials that can be selected to make the package and/or its contents and still achieve the desired visibility indication result. In a related aspect, this can be advantageous to enable the use of materials that have a Visibility Indication between the extremes of completely transparent and completely opaque, as discussed in reference to the Table below (e.g., in the range from 1 to 4).

TABLE

Sample Visibility Index Values

| Example | 3rd Visibility Index | 1st Index minus 3rd Index | 2nd Visibility Index | Visibility Indication |
|---|---|---|---|---|
| | | | Completely transparent | 5 |
| 1) | T = 0, H = ~100, C = ~0 | dT = +55, dH = −4, dC = +19 | T = 59, H = 62, C = 47 | 4 |
| 2) | T = 84, H = 81, C = 41 | dT = −29, dH = +15, dC = −22 | T = 59, H = 62, C = 47 | 3 |

TABLE-continued

Sample Visibility Index Values

| Example | 3rd Visibility Index | 1st Index minus 3rd Index | 2nd Visibility Index | Visibility Indication |
|---|---|---|---|---|
| 3) | T = 84, H = 81, C = 41 | dT = −29, dH = +15, dC = −22 | T = 58, H = 98, C = 15 | 2 |
| 4) | T = 84, H = 81, C = 41 | dT = −29, dH = +15, dC = −22 | T = 16, H = 92, C = 5 | 1 |
| | | | Completely opaque | 0 |
| 5) | T = 84, H = 81, C = 41 | dT = −29, dH = +15, dC = −22 | T = 87, H = 47, C = 36 | 4 |
| 6) | T = 84, H = 81, C = 41 | dT = −29, dH = +15, dC = −22 | T = 84, H = 56, C = 28 | 3 |
| 7) | T = 58, H = 98, C = 15 | dT = −4, dH = −2, dC = +4 | T = 59, H = 62, C = 47 | 2 |
| 8) | T = 58, H = 98, C = 15 | dT = −4, dH = −2, dC = +4 | T = 16, H = 92, C = 5 | 1 |
| 9) | T = 58, H = 98, C = 15 | dT = −4, dH = −2, dC = +4 | T = 23, H = 97, C = ~0 | 0 |
| 10) | T = 30, H = 98, C = ~0 | dT = +25, dH = −2, dC = +19 | T = 59, H = 62, C = 47 | 2 |
| 11) | T = 30, H = 98, C = ~0 | dT = +25, dH = −2, dC = +19 | T = 58, H = 98, C = 15 | 1 |
| 12) | T = 30, H = 98, C = ~0 | dT = +25, dH = −2, dC = +19 | T = 16, H = 92, C = 5 | 0 |
| 13) | T = 13, H = 99, C = ~0 | dT = +42, dH = −3, dC = +19 | T = 16, H = 92, C = 5 | 1 |
| 14) | T = 13, H = 99, C = ~0 | dT = +42, dH = −3, dC = +19 | T = 23, H = 97, C = ~0 | 0 |
| 15) | T = 54, H = 21, C = 91 | dT = +1, dH = +75, dC = −72 | T = 59, H = 62, C = 47 | 3 |
| 16) | T = 54, H = 21, C = 91 | dT = +1, dH = +75, dC = −72 | T = 16, H = 92, C = 5 | 2 |
| 17) | T = 54, H = 21, C = 91 | dT = +1, dH = +75, dC = −72 | T = 30, H = 99, C = ~0 | 1 |
| 18) | T = 54, H = 21, C = 91 | dT = +1, dH = +75, dC = −72 | T = 22, H = 99, C = ~0 | 0 |
| 19) | T = 87, H = 6, C = 97 | dT = −32, dH = +90, dC = −78 | T = 59, H = 62, C = 47 | 4 |
| 20) | T = 87, H = 6, C = 97 | dT = −32, dH = +90, dC = −78 | T = 58, H = 98, C = 15 | 2 |
| 21) | T = 87, H = 6, C = 97 | dT = −32, dH = +90, dC = −78 | T = 16, H = 92, C = 5 | 1 |
| 22) | T = 87, H-6, C = 97 | dT = −32, dH = +90, dC = −78 | T = 24, H = 99, C = 1 | 0 |
| 23) | T = 23, H = 13, C = 96 | dT = +32, dH = +83, dC = −77 | T = 59, H = 62, C = 47 | 4 |
| 24) | T = 23, H = 13, C = 96 | dT = +32, dH = +83, dC = −77 | T = 16, H = 92, C = 5 | 2 |
| 25) | T = 23, H = 13, C = 96 | dT = +32, dH = +83, dC = −77 | T = 24, H = 99, C = 1 | 1 |
| 26) | T = 23, H = 13, C = 96 | dT = +32, dH = +83, dC = −77 | T = 22, H = 99, C = ~0 | 0 |

Key:
"T" is total transmittance parameter;
"H" is haze parameter;
"C" is clarity parameter;
"dT" is difference in T for compared materials;
"dH" is difference in H for compared materials;
"dC" is difference in C for compared materials;
"~" means approximately.
First Visibility Index:
T = 55,
H = 96,
C = 19

Reference is now made to the Table to further describe the invention. The Table is the culmination of work done by the inventors to show the visibility indexes for several different materials, and as related to the invention. The particular materials used were far sample purposes and in no way limit the invention. Rather, it is the particular visibility index for such material and the comparison of those indexes which relate to components of the invention (i.e., wipe-first visibility index, versus container top-second visibility index, versus dispensing partition-third visibility index) that are significant. The Table sets out a Key at the top. Directly underneath the Key, there is seen the First Visibility Index for a material as if it were a wipe. Underneath the First Visibility Index are several columns. The first column identifies the various examples that were based on a comparison of different sample materials. The next column identifies the 3*rd* Visibility Index for a sample material as if it were a dispensing partition. The next column identifies the difference between the First Visibility Index and the Third Visibility Index for a given example. The next column identifies the 2*nd* Visibility Index for a sample material as if it were a container top. The last column identifies the Visibility Indication for a given example (i.e., whether the wipe from the group of wet wipes can be visibly indicated at the container top as being in-position or not-in-position for pop-up dispensing as soon as the container top is next opened).

The Visibility Indication is the qualitative visibility indication as seen through a pair of human eyes, where a rating of "5" means clearly visibly (i.e., as if the container top were a completely transparent material such as 1/18 inch thick clear glass) and decreasing degrees of visibility from "4", "3", "2" to "1" (i.e., where the wipe would still be visibly indicated as being in-position or not-in-position but not as clearly as "2" to "5") are shown for comparison purposes, and a rating of "0"means not visible at all (i.e., as if the container top were a completely opaque material such as ¼ inch thick plywood). With the components of the invention in their relative positions, the Visibility Indication was determined by positioning a one inch (2.5 cm) length of wipe sticking out of the dispensing orifice between the dispensing partition and the container top, and with the container top closed.

Further, and in reference to FIG. 1 for example, the Visibility Indication was determined by a human observing the package 10, with: the human's pair of eyes having a combined average vision of 20/20 or better; the eyes being positioned in the angle W from about 30 degrees to about 90 degrees above the horizontal axis 50; the eyes being at a distance 52 of between about 6 inches (15 cm) and about 12 inches (30 can); end, the eyes being at a distance 54 of between about 6 inches (15 cm) and about 18 inches (45 cm). In this way, simulating the container top being closed with the wipe partially dispensed thereunder, the human could then make a visual determination whether the wipe could be visibly seen at the container top, based on the visibility scale of "0" to "5". If the Visibility Indication was a "1" or higher, this meant that the particular configuration of materials simulating the package of the invention would visibly indicate to a user that the wipe was in-position for pop-up dispensing as soon as the container top was next opened. Using the same materials and if all else was constant but the wipe was displaced from the dispensing orifice, then a Visibility Indication of "1" to "5" would result In the wipe being visibly indicated as not-in-position for pop-up dispensing as soon as the container top was next opened. If the Visibility Indication was "0" then this would mean it did not matter if the wipe was in-position or not-in-position because no visual identification could be seen through the container top.

It should be understood that the Visibility Indication does not limit the invention per se. Rather, the Visibility Indication was used to define aspects of the visibility indexes for components of the invention. Particularly, it shows the combinations of and interactions of the components and Their visibility indexes to achieve the benefits of the invention, e.g., such that when the container top is closed the wipe from the group of wet wipes is visibly indicated at the container top as being in-position or not-in-position for pop-up dispensing as soon as the container top is next opened. In one regard, though, there is a lower limit that the interaction of the visibility indexes need to surpass (e.g., illustrated in the Table as a Visibility Indication of at least 1) or else it will simply not be possible to visibly indicate whether a wipe is in-position or not-in-position for pop-up dispensing as soon as the container top is next opened. Using the quantitative and qualitative information taught here, a manufacturer of a package could make the package have the desired features of the invention such that a user of the package would only ever have to make qualitative determinations to know that a wipe is in-position or not-in-position for pop-up dispensing as soon as the container top of the package is next opened.

Based on their research as exemplified here, and without being limited to a particular theory of operation, the inventors believe certain conclusions can be drawn to define aspects of the invention. In a first aspect, as relates to the visibility index difference between the $1^{st}$ and $3^{rd}$ visibility indexes, it can be advantageous to have dT be a positive value (e.g. compare, Examples 21 and 24, Examples 22 and 25, Examples 1 and 10, and Examples 12 and 13). In a second aspect, also related to the difference between the $1^{st}$ and $3^{rd}$ visibility indexes, it can be advantageous to have dH be a positive value and dC be a negative value (e.g. compare, Examples 2 and 7, Examples 2 and 10, Examples 2 and 19, Examples 3 and 11, Examples 4 and 12, and Examples 4 and 13). In a third aspect, as relates to the $2^{nd}$ visibility index, it can be advantageous to have a large T value (e.g. compare, Examples 17 and 18). In a fourth aspect, also related to the $2^{nd}$ visibility index, it can be advantageous to have a low H value and a high C value (e.g. compare, Examples 2 and 3, Examples 5 and 6, Examples 8 and 9, Examples 10 and 11, Examples 13 and 14, Examples 16, 17 and 18, and Examples 19 and 20). In a fifth aspect, it can be advantageous, depending on the dT, dH and dC, to have the C the second visibility index be greater than 1. In a sixth aspect, it can be advantageous, depending on the dT, dH and dC, to have the C of the second visibility index be greater than 5. In a seventh aspect, it can be advantageous, to have the H of the first visibility index be less than the H of the third visibility index and the C of the first visibility index be greater than the C of the third visibility index and the C of the second visibility index be greater than about 5, and more advantageously, greater than about 15. In an eighth aspect, it can be advantageous, to have the T of the first visibility index be less than the T of the third visibility index and the H of the first visibility index be less than the H of the third visibility index and the C of the first visibility index be greater than the C of the third visibility index and the C of the second visibility index be greater than about 5.

Also based on their research as exemplified here, and without being limited to a particular theory of operation, the inventors believe certain related conclusions can be drawn to define aspects of the invention. In one aspect, it can be advantageous to have the container top having a Visibility Indication of at least 1 and no more than 4, e.g., this can provide a broader operating window for available materials that can be selected to make the package and/or its contents and still achieve the desired visibility indication result. In another aspect, it can be advantageous to have the second visibility index being dependent upon the difference between the first visibility index and the third visibility index. In this same aspect, it can be more advantageous to have the second visibility index be inversely related to the difference between the first visibility index and the third visibility index, e.g., where the larger the value of dT, dH, and/or dC, the lower the value of T and/or C can be for the second visibility index to still practice the invention and the higher the value of H can be for the second visibility index to still practice the invention.

Wipes for use with the present invention, e.g., wet wipes, can be arranged in a package or dispenser in any manner which provides convenient and reliable one at a time dispensing and which assists the wet wipes in not becoming overly dry. For example, the wet wipes can be arranged in a dispenser or package as a plurality of individual wipes arranged in a stacked configuration to provide a stack of wet wipes which may or may not be individually folded. The wet wipes can be individual wet wipes which are folded in a c-fold configuration, z-fold configuration, connected to adjacent wipes by a weakened line or other non-interfolded configurations as are known to those skilled in the art. Alternatively, the individual wet wipes can be interfolded such that the leading and trailing end edges of successive wipes in the stacked configuration overlap. In each of these non-interfolded and interfolded configurations, the leading end edge of the following wet wipe is loosened from the stack by the trailing end edge of the leading wet wipe as the leading wet wipe is removed by the user from the dispenser or package. For example, representative wet wipes for use with the invention are described in a U.S. patent application filed May 31, 2001 entitled, "PROCESS FOR JOINING WET WIPES TOGETHER AND PRODUCT MADE THEREBY" of inventors Yung H. Huang et al., U.S. Ser. No. 09/870,815, assigned to the same assignee of this application, as well as, in a U.S. patent application filed May 31, 2001 entitled, "STACK OF FAN FOLDED MATERIAL AND COMBINATIONS THEREOF" of inventor Gerald K. Sosalla, U.S. Ser. No. 09/871,019, assigned to the same assignee of this application, both which applications are incorporate fully herein by reference.

Another aspect of the invention concerns a method for storing and dispensing wet wipes in a pop-up format, e.g., with the package 10. The package may come to a consumer with a first wipe already positioned in the dispensing orifice or a first wipe needing to be positioned before dispensing the first wipe in the group of wet wipes. In either case, the first wipe (or subsequent wipes if due to fallback) can be positioned in the dispensing orifice by (1) opening the container top and then reaching through the dispensing orifice from the top of the container to pull and thread the first wipe back through the orifice by, e.g., slit 28 if the orifice is sufficiently non-rigid or large or is a sufficiently large opening, or (2) by opening the dispensing partition 24 to thread the first wipe up through the dispensing orifice while the container top is closed or open and then closing the partition 24 on the container base (and top onto the partition if it was open). With the wipe so threaded in the dispensing orifice of a package of the invention, the user can determine that the first wipe (or subsequent wipes similarly located) is in-position for pop-up dispensing as soon as the container top is next opened. Thus, the user can begin a wiping activity (e.g., diaper changing, surface preparation, etc.) and then open the container top and dispense the pop-uped wipe and continue conducting the wiping activity conveniently and safely. If the user does not immediately need the next wipe, it can be left in the orifice partially dispensed where it can be maintained in place by the pop-up style dispensing orifice until desired later, and the container top can be closed to better preserve moisture in the group of wipes or left open, as desired.

With the container top closed, and provided the succeeding partially dispensed wipe rests in place in the orifice, part inside the container base and part in the space between the container top and the dispensing partition, the user will be able to determine at a later time that the next wipe is in-position for pop-up dispensing as soon as the container top is next opened. Alternatively, at a later time when it is desired, if the following wipe needs to be fetched out of the container base similar to the first wipe (e.g., because the user pushed the following wipe back into the container base storage portion after pop-up dispensing of the leading wipe or through wipe fallback), the user can determine that the next wipe is not-in-position, by a mere visual inspection of the top of the container. In such a case, the user can re-thread the next wipe, similar to the way they did first wipe, before conducting a wiping activity so one or both of their hands are available to re-thread the next wipe as needed. Then, once re-threaded, the user can conduct a wiping activity more safely and conveniently since only one hand will be needed for assured pop-up dispensing. At a later time when another wipe(s) is desired, the preceding steps can generally be followed again.

As discussed previously, the determining of the visibility index that a user may perform as concerns the invention is not a rigorous quantitative measuring with the visibility index test, but rather, is a qualitative observation of the visual characteristics attributable to the visibility indexes, as seen through a pair of human eyes viewing the package at a set elevation and a set distance. In reference to FIG. 1, for example, such determining by a user without making quantitative measurements of the visibility index can be made by a human observing the package 10 in a closed condition, with: the human's pair of eyes having a combined average vision of 20/20 or better; the eyes being positioned in the angle W from about 30 degrees to about 90 degrees above the horizontal axis 50; the eyes being at a distance 52 of between about 6 inches (15 cm) and about 12 inches (30 cm); and, the eyes being at a distance 54 of between about 6 inches (15 cm) and about 18 inches (45 cm). In this way, the human can make a visual determination whether the wipe in the package is in-position or not-in-position for pop-up dispensing as soon as the container top is next opened.

Figure 3:
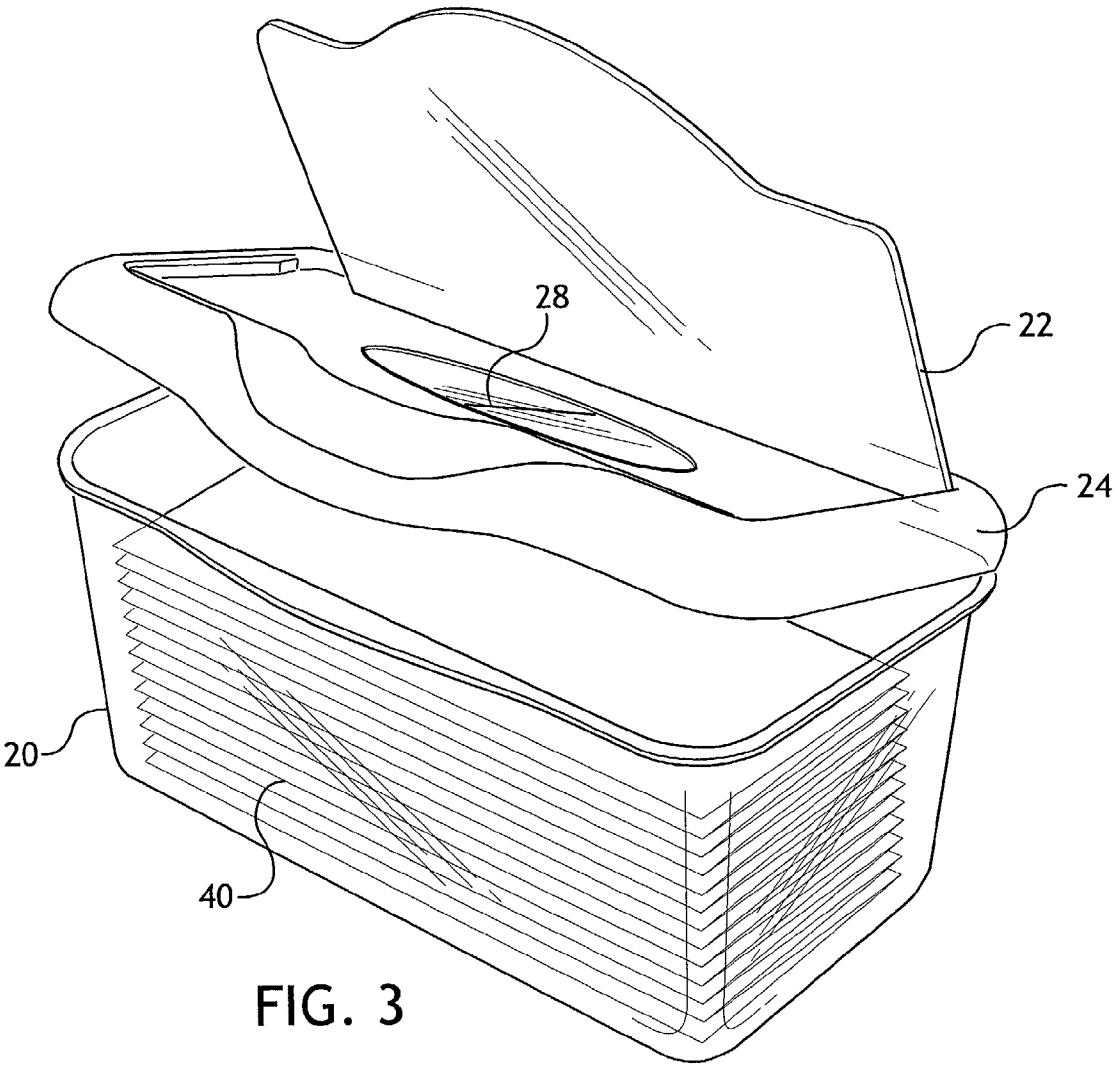
FIG. 3 representatively shows the package of FIG. 2 but with the dispensing partition pivotally separable from the container base as well as the container top, and with no wipe in-position for dispensing.

The features of the present invention can be used with a variety of dispensers if such dispensers are modified based on the teachings herein. An example of some such dispensers are seen in FIGS. 1–3 of U.S. Ser. No. 09/870,785 supra. FIGS. 1 and 2 show wet wipe dispensers having rigid plastic containers. FIG. 3 shows a wet wipes dispenser having a flexible container (e.g., a form, fill, seal type of film container) with a rigid port member attached thereto. Each dispenser includes a top hingedly attached adjacent an end portion of the dispenser. In FIGS. 1 and 2, the dispensers have a removable cover which contains the rigid port which surrounds the flexible, rubber-like sheet. The cover can be fixedly or removably secured to the sidewalls of the base. For each dispenser in FIGS. 1–3, the top is secured in a closed position by a suitable latching mechanism. The shape of the rigid port in the dispensers shown in FIGS. 1 and 2 is oval and in FIG. 3 rectangular, but such port (i.e., and thus the flexible orifice contained within the port) can be any shape and size large enough to enable some clearance between the ends of the continuous slit and the rigid port so as to not interfere with the dispensing function of the flexible orifice.

Another example of dispensers which could include features of the invention if they are modified based on the teachings herein, are seen in U.S. Ser. No. 09/813,536 filed Mar. 21, 2001 entitled "STORAGE AND DISPENSING PACKAGE FOR WIPES" assigned to the same assignee of this application and which application is incorporate fully herein by reference. The dispensers in this reference are completely made of flexible film and include a resealable container top and a container base with a pop-up style dispensing partition comprising a dispensing orifice positioned between the top and the base. Still another example of dispensers which could include features of the invention if they are modified based on the teachings herein, are seen in U.S. Des. Pat. No. 414,637 issued Oct. 5, 1999, assigned to the same assignee of this application and which application is incorporate fully herein by reference, as well as, commercially available baby wipes dispensing tub product like that known as currently available PAMPERS® One-Ups!™ of the Procter & Gamble Company of Cincinnati, Ohio 45202, USA.

All publications, patents, and patent documents cited in the specification are incorporated by reference herein, as though individually incorporated by reference. In the case of any inconsistencies, the present disclosure, including any definitions herein, will prevail. While the invention has been described in detail with respect to the specific aspects thereof, it will be appreciated that those skilled in the art, upon attaining an understanding of the foregoing, may readily conceive of alterations to, variations of, and equivalents to these aspects which fall within the spirit and scope of the present invention, which should be assessed accordingly to that of the appended claims.

What is claimed is:

1. A package for storing and dispensing wet wipes in a pop-up format, comprising:

a container base connected with a container top and a pop-up style dispensing partition positioned between the container base and the container top;

a group of wet wipes positioned in the container base between the container base and the pop-up style dispensing partition, each wipe in the group of wet wipes having a first visibility index;

the pop-up style dispensing partition comprising a dispensing orifice through which a wipe from the group of wet wipes is removed from the package when the top is open;

wherein the container top has a second visibility index and the pop-up style dispensing partition has a third visibility index and the first visibility index is different than the third visibility index such that when the container top is closed the wipe from the group of wet wipes is visibly indicated at the container top as being in-position or not-in-position for pop-up dispensing as soon as the container top is next opened; and wherein each of the first, second, and third visibility indexes comprises the visibility characteristics of total transmittance, haze and clarity and wherein the container top has a Visibility indication of at least 1 and no more than 4.

2. The package of claim 1 wherein the total transmittance of the first visibility index is greater than the total transmittance of the third visibility index.

3. The package of claim 1 wherein the haze of the first visibility index is greater than the haze of the third visibility index and the clarity of the first visibility index is less than the clarity of the third visibility index.

4. The package of claim 2 wherein the clarity of the second visibility index is greater than 1.

5. The package of claim 3 wherein the clarity of the second visibility index is greater than 1.

6. The package of claim 2 wherein the clarity of the second visibility index is greater than 5.

7. The package of claim 3 wherein the clarity of the second visibility index is greater than about 5.

8. The package of claim 2 wherein the haze of the first visibility index is less than the haze of the third visibility index and the clarity of the first visibility index is greater than the clarity of the third visibility index and the clarity of the second visibility index is greater than about 5.

9. The package of claim 2 wherein the haze of the first visibility index is less than the haze of the third visibility index and the clarity of the first visibility index is greater than the clarity of the third visibility index and the clarity of the second visibility index is greater than about 15.

10. The package of claim 1 wherein the total transmittance of the first visibility index is less than the total transmittance of the third visibility index and the haze of the first visibility index is less than the haze of the third visibility index and the clarity of the first visibility index is greater than the clarity of the third visibility index and the clarity of the second visibility index is greater than about 5.

11. The package of claim 1 wherein the second visibility index is dependent upon the difference between the first visibility index and the third visibility index.

12. The package of claim 11 wherein the second visibility index is inversely related to the difference between the first visibility index and the third visibility index.

13. The package of claim 1 wherein one or both of the container base and the container top is made of a rigid material.

14. A package for storing and dispensing wet wipes in a pop-up format, comprising:

a container base connected with a container top and a pop-up style dispensing partition positioned between the container base and the container top;

a group of wet wipes positioned in the container base between the container base and the pop-up style dispensing partition, each wipe in the group of wet wipes having a first visibility index;

the pop-up style dispensing partition comprising a dispensing orifice through which a wipe from the group of wet wipes is removed from the package when the top is open;

wherein the container top has a second visibility index and the pop-up style dispensing partition has a third visibility index and the first visibility index is different than the third visibility index; and wherein each of the first, second, and third visibility indexes comprises the visibility characteristics of total transmittance, haze and clarity and wherein the container top has a Visibility Indication of at least 1 and no more than 4.

15. The package of claim 14 wherein the second visibility index is dependent upon the difference between the first visibility index and the third visibility index.

16. The package of claim 14 wherein the second visibility index is inversely related to the difference between the first visibility index and the third visibility index.

* * * * *